United States Patent [19]

Fullerton

[11] Patent Number: 4,675,620

[45] Date of Patent: Jun. 23, 1987

[54] COPLANAR WAVEGUIDE CROSSOVER

[75] Inventor: Craig L. Fullerton, Scottsdale, Ariz.

[73] Assignee: Motorola, Inc., Schaumburg, Ill.

[21] Appl. No.: 835,596

[22] Filed: Mar. 3, 1986

[51] Int. Cl.[4] ..... H01P 5/12

[52] U.S. Cl. ..... 333/1; 333/238

[58] Field of Search ..... 333/1, 128, 33, 238, 333/246

[56] References Cited

U.S. PATENT DOCUMENTS 3,095,549 6/1963 Butler .
3,104,363 9/1963 Butler .
3,842,360 10/1974 Dickens ..... 333/238 X
4,533,883 8/1985 Hudspeth et al. ..... 333/1

*Primary Examiner*—Paul Gensler
*Attorney, Agent, or Firm*—Raymond J. Warren

[57] ABSTRACT

The present invention consists of a crossover for coplanar waveguides. A pair of microstrip/strip line conductors are transitioned into coplanar conductors on opposite sides of a substrate. This places the electrical and magnetic fields in an orthogonal relation so as to reduce the possible interference. Once crossed the coplanar conductors are transitioned back to microstrip/strip line conductors.

7 Claims, 5 Drawing Figures

COPLANAR WAVEGUIDE CROSSOVER

BACKGROUND OF THE INVENTION

This invention relates, in general, to crossovers and, more particularly, to coplanar waveguide crossovers.

Several types of crossovers are known in the art, such as the Butler U.S. Pat. Nos. 3,104,363 and 3,095,549. The basic problem throughout these prior art patents is that the electrical (E) fields of the crossing conductors are in the same plane and overlap each other. This can cause a mismatch in the impedance of the circuit containing the crossover.

In Butler U.S. Pat. No. 3,104,363 the width of the conductors is varied to try to compensate for the change in impedance caused by the crossover area. However, the E fields of the two conductors remain in the same plane which presents the need for the physical variances. In Butler U.S. Pat. No. 3,095,549 a pair of dual conductors is used to create a short area therebetween through which the crossing conductor is placed. This device requires the use of three layers of substrate and still has the E fields running in the same plane.

SUMMARY OF THE INVENTION

Accordingly, it is an object of the present invention to provide a coplanar waveguide crossover that overcomes the above deficiencies.

A further object of the present invention is to provide a coplanar waveguide crossover that provides a high amount of electro-magnetic isolation between the crossing conductors.

Another object of the present invention is to provide a coplanar waveguide crossover that does not require the addition of extra substrates or conductors.

Still another object of the present invention is to provide a coplanar waveguide crossover that is simple and consistent.

Yet another object of the present invention is to provide a coplanar waveguide crossover that allows for repeatable amplitude and phase performances.

The above and other objects and advantages of the present invention are provided by the coplanar waveguide crossover described herein.

A particular embodiment of the present invention consists of a coplanar waveguide crossover comprising a pair of microstrip/strip lines that are transitioned to coplanar waveguide structures which are then crossed and transitioned back to microstrip/strip lines.

DETAILED DESCRIPTION OF THE DRAWINGS

Figure 1:
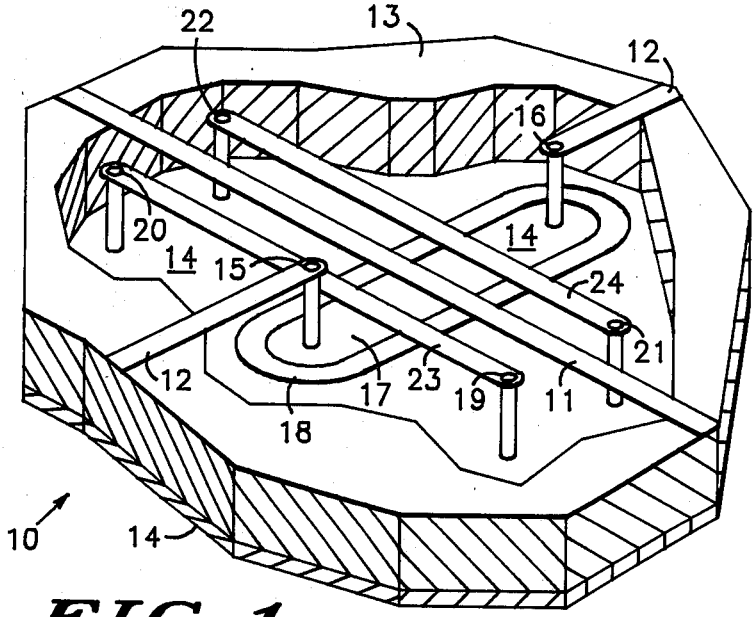
FIG. 1 is a perspective view, with portions being broken away, of a coplanar waveguide crossover embodying the present invention.

Referring now to the drawing of FIG. 1, a perspective view, with portions being broken away, of a coplanar waveguide crossover, generally designated 10, embodying the present invention is illustrated. Coplanar waveguide crossover 10 consists of a pair of conductors 11 and 12 mounted on a substrate 13. Below substrate 13 is a ground plane 14. A pair of holes 15 and 16 are plated through substrate 13 to the area of ground plane 14. Plated holes 15 and 16 are coupled together by a third conductor 17. Conductor 17 is isolated from ground plane 14 by a nonconductive area 18. A second set of holes 19 and 20 and a third set of holes 21 and 22 are plated through substrate 13 to couple to ground plane 14. Plated holes 19 and 20 are coupled by a conductor 23 and plated holes 21 and 22 are coupled by a conductor 24.

Figure 2:
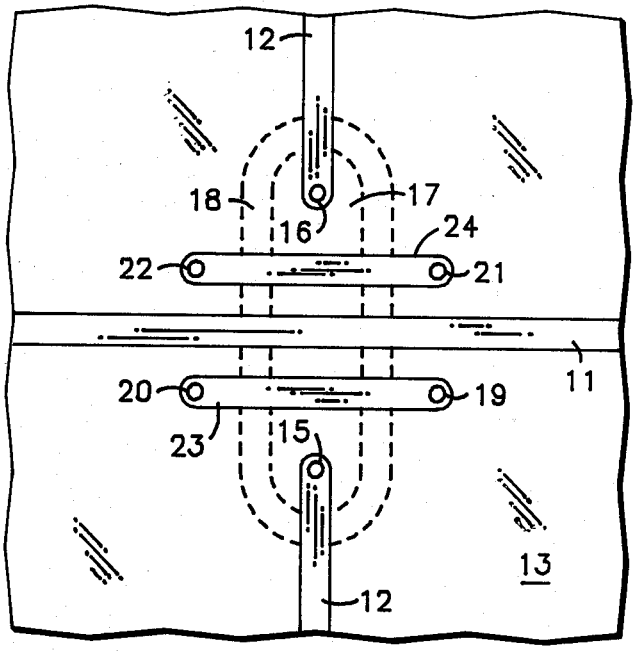
FIG. 2 is a top view of a coplanar waveguide crossover embodying the present invention.

FIG. 2 shows a top view of the present invention. As shown in FIG. 2 conductor 11 starts as a microstrip/strip line; transitions to a coplanar waveguide when parallel to conductors 23 and 24; and transitions back to a microstrip/strip line. Conductor 12 is a microstrip/strip line and conductor 17 is the corresponding coplanar waveguide.

Figure 3:
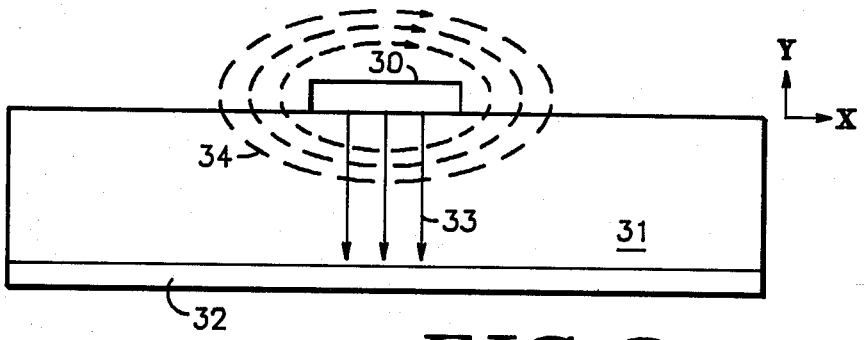
FIG. 3 is a diagram illustrating the E fields in a microstrip/strip line.

Referring now to the diagram of FIG. 3, the electrical (E) and magnetic (M) fields are illustrated for a microstrip/strip line conductor. As shown, a conductor 30 is mounted on a substrate 31 having a ground plane 32. The E fields are represented by solid arrows 33 and the M fields are represented by dashed arrows 34. The E field is shown here in the Y direction and the M field is shown in the X-Y plane. If a second conductor were to be added to FIG. 3 in a crossing manner with respect to conductor 30, the second conductor would have an E field running in the Y direction and an M field in the Y-Z plane. Where the two conductors cross the M fields would be perpendicular to each other and therefore would not interfere. The E fields would run in the same direction and therefore would effect each other. This could result in causing a mismatch of the impedance.

Figure 4:
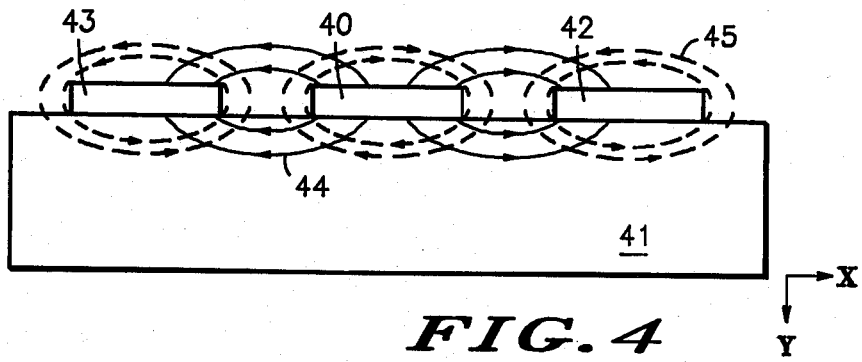
FIG. 4 is a diagram illustrating the E fields in a coplanar waveguide.

Referring now to the diagram of FIG. 4, the electrical (E) and magnetic (M) fields are illustrated for a coplanar waveguide. As shown, a conductor 40 is disposed on a substrate 41 between a pair of ground strips 42 and 43. The E fields are represented by solid arrows 44 and the M fields by dashed arrows 45. The E field of conductor 40 is shown in the X-Y plane as is the M field. If a second coplanar waveguide were added to FIG. 4 that was perpendicular and crossed conductor 40 the E field would be in the Y-Z plane as would the M field. This would make the E and M fields of the two conductors orthogonal which would not have an effect on each other.

As shown in FIG. 1, conductive lines 11 and 17 are coplanar waveguides and would have their E and M fields perpendicular to one another thereby eliminating the interference that could result. In operation, conductor 11 would have an E field running in the Y direction as it approached the crossover area. Once conductor 11 reached the area having coplanar ground planes 23 and 24, the E field would be rotated so that it was in the X-Y plane. Conductor 12 of FIG. 1 would also have an E field in the Y direction as it approached the crossover area. When conductor 12 transitions to conductor 17, the E field is rotated and is now in the Y-Z field. Therefore, when conductors 11 and 17 cross, the E fields are orthogonal to each other, as are the M fields.

Because of the existence of ground plane 14 certain dimensions of the coplanar waveguide should try to be maintained or a portion of the E fields of the two conductors, in the Y direction, will remain and cause the problems set out above. One possible solution would be to eliminate ground plane 14 about the crossover area and provide conductor 17 with a pair of coplanar ground planes. This would take some special processing that can be avoided by complying with the requirements below.

Figure 5:
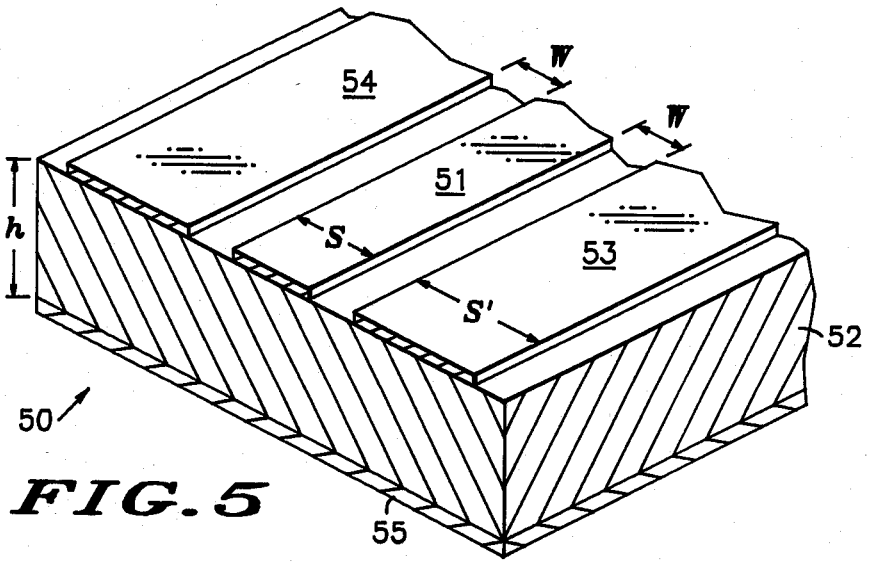
FIG. 5 is a partial cross-sectional view, in perspective, of a coplanar waveguide crossover embodying the present invention.

Referring now to the diagram of FIG. 5, a coplanar waveguide 50 is illustrated. Waveguide 50 consists of a conductor 51 mounted on a substrate 52 between a pair of coplanar ground planes 53 and 54. Also shown is a ground plane 55. Ground plane 55 is not required for a coplanar waveguide but is illustrated here to show the relation to the coplanar waveguide crossover of FIG. 1.

In FIG. 5, the characteristic impedance of coplanar waveguide 50 is determined by the height (h) of substrate 52; the thickness (t) of conductor 51; the dielectric constant ($E_r$) of substrate 52; the gap width (W) between conductor 51 and ground plane 53 (54); the width (S) of conductor 51; and the width (S') of ground plane 53 (54). Typically those skilled in the transmission line modeling art use elliptical integrals K(k) for modeling purposes. Accordingly, the characteristic impedance can be represented by:

$$Z_0 = \left[\frac{30\pi}{\sqrt{E'_{re}}}\right]\left[\frac{K'(k_e)}{K(k_e)}\right] \quad (1)$$

where, $K'(k) = K(k')$ $$\frac{K(k_e)}{K'(k_e)} = \frac{1}{\pi}\ln(2)\frac{1+\sqrt{k_e}}{1-\sqrt{k_e}} \text{ for } 0.707 \leqq k_e \leqq 1, \text{ or}$$

$$\frac{K(k_e)}{K'(k_e)} = \frac{\pi}{\ln(2)\dfrac{1+\sqrt{k_e'}}{1-\sqrt{k_e'}}} \text{ for } 0 \leqq k_e \leqq 0.707.$$

The effective ratio, $k_e$, between the width of conductor 51 and the distance between conductor 51 and ground plane 53 (54) is represented by:

$$k_e = \frac{S_e}{S_e + 2W_e} \text{ and } k_e' = \sqrt{1-k_e^2}$$

where $S_e = S + \Delta$ and $W_e = W - \Delta$ and where:

$$\Delta = (1.25t/\pi)[1 + \ln(4\pi S/t)].$$

The effective dielectric constant, $E_{re}$, for a constant finite thickness, t, of conductor 51 is defined by:

$$E'_{re} = E_{re} - \frac{0.7(E_{re}-1)t/W}{[K(k)/K'(k)] + 0.7\,t/W}.$$

If the coplanar ground strips are too small the characteristic impedance is affected. As long as a ratio of $2S'/(S+2W) > 1.5$ is maintained the characteristic impedance of the coplanar waveguide is not affected.

As long as a high impedance is maintained, having the sufficient combination of large S and t and a small W, coplanar ground planes 53 and 54 will be dominant over the microstrip/strip line ground plane 55. If a lesser amount of precision is desired, then the impedance can be reduced by varying the parameters W, S and t.

Thus, it is apparent to one skilled in the art that there has been provided in accordance with the invention, a device that fully satisfies the objects, aims and advantages set forth above.

It has been shown that the present invention provides a coplanar waveguide crossover that provides a high amount of electro-magnetic isolation between the crossing conductors; that does not require the addition of extra substrates; and that is simple and consistent.

While the invention has been described in conjunction with specific embodiments thereof, it is evident that many alterations, modifications, and variations will be apparent to those skilled in the art in light of the foregoing description. Accordingly, it is intended to embrace all such alterations, modifications and variations in the appended claims.

I claim:

1. A coplanar waveguide crossover having first, second, third and fourth ports, said crossover comprising:

a substrate having a first side and a second side;

a first conductor having a first end and a second end, said first end coupled to said first port of said crossover, said first conductor being disposed on said first side of said substrate;

a first coplanar waveguide having a first end coupled to said second end of said first conductor and a second end, said first coplanar waveguide being disposed on said first side of said substrate;

a second conductor having a first end coupled to said second end of said first coplanar waveguide and a second end coupled to said third port of said coplanar waveguide crossover, said second conductor being mounted on said first side of said substrate;

a third conductor having a first end coupled to said second port of said coplanar waveguide crossover and a second end, said third conductor being disposed on said first side of said substrate;

a second coplanar waveguide having a first end coupled to said second end of said third conductor and a second end, said second coplanar waveguide being disposed on said second side of said substrate such that said second coplanar waveguide is orthogonally disposed with respect to said first coplanar waveguide; and a fourth conductor having a first end coupled to said second end of said second coplanar waveguide and a second end coupled to said fourth port of said coplanar waveguide crossover, said fourth conductor being disposed on said first side of said substrate.

2. The coplanar waveguide crossover of claim 1 further comprising a ground plane being disposed on said second surface of said substrate and being disposed about and juxtaposed to said second coplanar waveguide.

3. The coplanar waveguide crossover of claim 1 wherein said first coplanar waveguide comprises:

a first coplanar conductor having a first end coupled to said second end of said first conductor and a second end being coupled to said first end of said second conductor;

a first coplanar ground plane being juxtaposed to said first coplanar conductor; and a second coplanar ground plane being juxtaposed to said first coplanar conductor.

4. The coplanar waveguide crossover of claim 1 wherein said second coplanar waveguide comprises a second coplanar conductor disposed, in a noncontacting relation, in a plane defined by said ground plane with said ground plane functioning as a coplanar ground for said second coplanar waveguide.

5. A coplanar waveguide crossover having first, second, third and fourth ports, said crossover comprising:

a substrate having a first side and a second side;

a first conductive strip having a first end coupled to said first port of said crossover and a second end being coupled to said third port of said crossover, said first conductive strip being disposed on said first side of said substrate;

a first ground strip being juxtaposed to a portion of said first conductive strip, said first ground strip being disposed on said first side of said substrate;

a second ground strip being juxtaposed to said portion of said first conductive strip opposite said first ground strip, said second ground strip being disposed on said first side of said substrate;

a second conductive strip having a first end coupled to said second port of said crossover and a second end, said second conductive strip being disposed on said first side of said substrate;

a third conductive strip having a first end coupled to said second end of said second conductive strip and a second end, said third conductive strip being disposed on said second side of said substrate and orthogonally disposed with respect to said first conductive strip;

a fourth conductive strip having a first end coupled to said second end of said third conductive strip and a second end being coupled to said fourth port of said crossover; and a ground plane being disposed on said second surface of said substrate and being disposed about and juxtaposed to said third conductive strip.

6. A coplanar waveguide crossover having first, second, third, and fourth ports, said crossover comprising:

a substrate having a first side and a second side, said substrate defining first, second, third, fourth, fifth, and sixth holes extending from said first side to said second side, said substrate defining the holes being coated with a conductive material;

a ground plane being disposed on said second side of said substrate, said ground plane being coupled to said conductive material coating said substrate defining the first, second, third and fourth holes;

a first conductive strip having a first end coupled to said first port of said crossover and a second end being coupled to said third port of said crossover, said first conductive strip being disposed on said first side of said substrate;

a first ground strip being juxtaposed to a portion of said first conductive strip, said first ground strip having a first end coupled to said conductive material coating said substrate defining said first hole and a second end coupled to said conductive material coating said substrate defining said second hole, said first ground strip being disposed on said first side of said substrate;

a second ground strip being juxtaposed to said portion of said first conductive strip, said second ground strip having a first end coupled to said conductive material coating said substrate defining the third hole and a second end coupled to said conductive material coating said substrate defining the fourth hole, said second ground strip being disposed on said first side of said substrate;

a second conductive strip having a first end coupled to said second port of said crossover and a second end coupled to said conductive material coating said substrate defining the fifth hole, said second conductive strip being disposed on said first side of said substrate;

a third conductive strip having a first end coupled to said conductive material coating said substrate defining the fifth hole and a second end coupled to said conductive material of said substrate defining the sixth hole, said third conductive strip being disposed on said second side of said substrate and orthogonally disposed with respect to said first conductive strip; and a fourth conductive strip having a first end coupled to said conductive material coating said substrate defining said sixth hole and a second end being coupled to said fourth port of said crossover.

7. A coplanar waveguide crossover comprising a pair of conductors which are each transitioned into coplanar conductors, a substrate on which said conductors are located, each of said coplanar conductors having electrical and magnetic fields, and crossed on opposite sides of said substrate, resulting in the electrical and magnetic fields being disposed in an orthogonal relation to one another, said coplanar conductors are transitioned back to a pair of conductors.

* * * * *